US007628708B2

(12) United States Patent
Metz

(10) Patent No.: US 7,628,708 B2
(45) Date of Patent: Dec. 8, 2009

(54) GOLF SWING INSTRUCTION AIDE

(76) Inventor: Michael Metz, 4839 Goliad Cir., Simi Valley, CA (US) 93063

( * ) Notice: Subject to any disclaimer, the term of this patent is extended or adjusted under 35 U.S.C. 154(b) by 40 days.

(21) Appl. No.: 12/237,544

(22) Filed: Sep. 25, 2008

(65) Prior Publication Data

US 2009/0088265 A1 Apr. 2, 2009

Related U.S. Application Data

(60) Provisional application No. 60/995,622, filed on Sep. 28, 2007.

(51) Int. Cl.
*A63B 69/36* (2006.01)

(52) U.S. Cl. ..... 473/213; 473/227

(58) Field of Classification Search ..... 473/206, 473/207, 212, 213, 219, 223, 226, 227, 266, 473/276

See application file for complete search history.

(56) References Cited

U.S. PATENT DOCUMENTS

| | | | | | |
|---|---|---|---|---|---|
| 4,017,086 | A * | 4/1977 | Washburn | ..... | 473/212 |
| 5,324,038 | A * | 6/1994 | Sasser | ..... | 473/212 |
| 5,511,788 | A * | 4/1996 | Manley et al. | ..... | 473/213 |
| 5,895,326 | A * | 4/1999 | Cozza et al. | ..... | 473/213 |
| 6,251,025 | B1 * | 6/2001 | Brock et al. | ..... | 473/227 |

* cited by examiner

*Primary Examiner*—Nini Legesse
(74) *Attorney, Agent, or Firm*—Billy A. Robbins

(57) ABSTRACT

A golf swing instruction aide adopted for attachment to the shaft of a golf club to measure or control the amount of wrist cock of the golfer during the golf swing. The aide includes first and second arcuate members one of which is adopted to be affixed to the shaft of a golf club and the other of which is movable to the first arcuate member and includes indicia to show the amount of relative movement and further includes apparatus to restrict relative movement to a desired amount.

13 Claims, 3 Drawing Sheets

GOLF SWING INSTRUCTION AIDE

RELATED APPLICATIONS

This invention is based on Provisional Patent Application No. 60/995,622 filed Sep. 28, 2007 and claims the benefit of the filing date thereof.

FIELD OF THE INVENTION

The present invention relates to golf swing instruction and more particularly to a golf swing instruction aide which measures and may control the amount of wrist cock a golfer makes during the swing portion of a golf swing.

BACKGROUND OF THE INVENTION

It is well known that in order to achieve the desired distance of travel of a golf ball as a result of the golfer's striking the golf ball with the golf club, the golfer must accomplish the desired amount of wrist cock during the back swing. It is almost impossible for the golfer himself to feel the amount of wrist cock taken during the execution of the golf swing, it is impossible for the golfer to see himself during the execution of the wrist cock portion of the swing.

There are numerous golf instruction aides in the prior art and each is useful to assist the golfer or to assist the instructor in the teaching and perfecting various portions of the golf swing. The aides known to the prior art generally are useful in assisting the golfer to stay on a particular swing plane, to make the desired hip turn, to make the desired shoulder turn, to accomplish the desired follow through, to assist the golfer in execution of the proper grip on the golf club or the like. Applicant is unaware of any golf swing instruction aide which measures and or controls the wrist cock taken by the golfer during the golf swing. There is thus a need in the golf swing instruction art for an apparatus which is easily used by a golfer to assist in measuring and or controlling the amount of wrist cock during the back swing of the golf swing thereby assisting the golfer in perfecting the golf swing and also by an instructor in working with the golfer to accomplish the desired amount of wrist cock during the back swing of the golf swing.

SUMMARY OF THE INVENTION

A golf swing instruction aide comprising first and second arcuate members, one of which is adapted for attachment to the shaft of a golf club adjacent to the grip thereof, the other of said first and second arcuate members being movable relative to the arcuate member which is attached to the golf club shaft and means for controlling the amount of relative movement between the first and second arcuate members.

In accordance with another aspect of the present invention, there is provided an alignment means at the distal end of the other of the first and second arcuate members. The alignment means functions to align the instruction aide properly by seating against the user's arm during the golf swing.

As still further modification of the present invention, the arcuate member attached to the shaft of the golf club may also include means to limit the amount of back swing which the user may take during execution of the golf swing.

As a still further modification of the present invention there is provided means for measuring the amount of relative movement between the first and second arcuate members resulting from the back swing portion of a golf swing.

DETAILED DESCRIPTION

The present invention is a golf swing instruction aide which is attachable to the shaft of a golf club adjacent the grip thereof. The golf swing instruction aide is specifically designed to be used by any golfer to provide an immediate feedback to the golfer of the amount of wrist cock which the golfer has taken during a golf swing. The apparatus is adjustable on the shaft of a golf club to adapt to the swing of the individual golfer using the same. Once it is so adjusted, the apparatus is then placed in a position such that when the golfer takes his normal golf swing including the full back swing and the wrist cock the apparatus will automatically measure the amount of wrist cock which the golfer has taken and will maintain that measurement so that when the golfer has completed the golf swing he or she may then view the apparatus and have a visual indication of the amount of wrist cock which the golfer has taken during execution of the golf swing. This will allow the golfer to refine this portion of the golf swing and during practice sessions to develop the precise amount of wrist cock required to execute the shots which the golfer desires. Although the amount of wrist cock desired for achieving maximum distance is 90 degrees, it will be understood by those skilled in the art that a wrist cock of less than this amount is desired for other shots which may be executed during the game of golf such, for example, as bunker shots, pitch shots, half or three quarter wedge shots, approaching the green or the like. The precise execution of these short game shots will result in lower scores for the golfer. Repeatability of the golf swing in executing these shots is the key to successful short game execution. The golf swing instruction apparatus of the present invention will allow the golfer to practice these shots and to achieve and perfect a repeatable wrist cock for execution of each of the shots desired.

Figure 1:
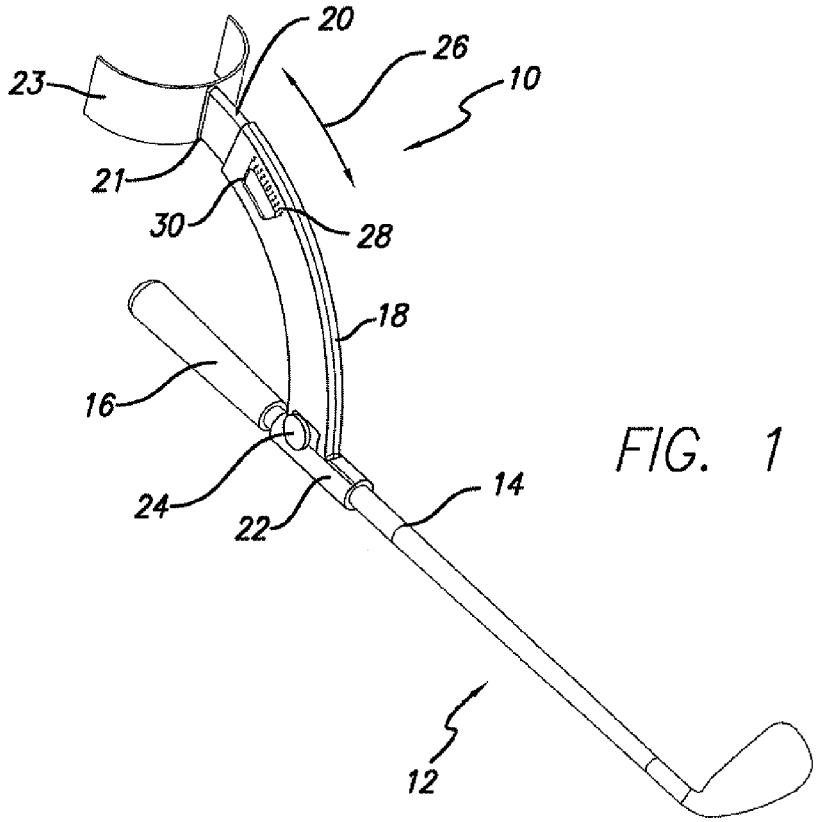
FIG. 1 is a perspective view showing the golf swing instruction aide of the present invention affixed to a golf club.

Referring now more particularly to FIG. 1, there is shown the golf swing instruction aide 10 of the present invention which is attached to a golf club 12. The instruction aide as is illustrated may be attached to the shaft 14 of the golf club 12 adjacent the grip 16 thereof. The instruction aide 10 includes a first arcuate member 18 and a second arcuate member 20. The first arcuate member is adapted for attachment to the shaft 14 of the golf club 12 by any means which may be utilized to accomplish this purpose and as is illustrated in FIG. 1 that means would include a clamp 22 which may be fitted around the shaft of the golf club and then by manipulating a fastener such as a threaded screw or the like 24, the arcuate member 18 may be rigidly attached to the shaft 14 of the golf club 12. The arcuate member 20 is movable relative to the arcuate member 18 so that the member 20 may slide into and out of the arcuate member 18 as is illustrated by the arrow 26. The distal end 21 of the arcuate member 20 has affixed thereto a curved member or bow 23 disposed orthogonally to the longitudinal axis of the arcuate member 20 and is arranged to engage the user's arm to align the instruction air 10 properly and to control the amount of wrist cock taken during the back swing or alternatively to move member 20 with respect to member 18 to allow measurement of the amount of wrist cock taken during the back swing taken by the golfer. Indicia 28 is placed on the surface of the arcuate member 20 which indicia is indicative of the amount of wrist cock taken by the golfer during the back swing of the golf swing. A window 30 is provided in the arcuate member 18 through which the golfer may view the position taken by the arcuate member 20 during the wrist cock of the back swing of the golf swing. A more detailed description of the method of utilizing the golf swing instruction aide of the present invention will be given hereinbelow.

Figure 2:
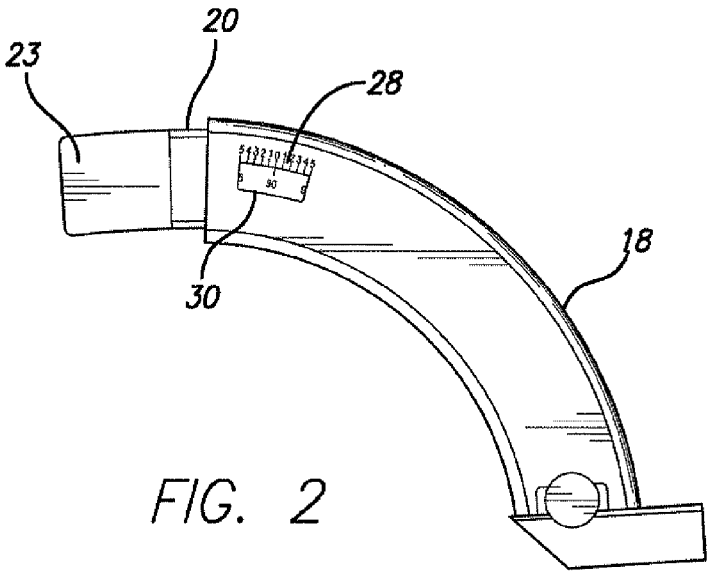
FIG. 2 illustrates the instruction aide of the present invention detached from the golf club and set at a position illustrative of a 90 degree wrist cock.
Figure 3A:
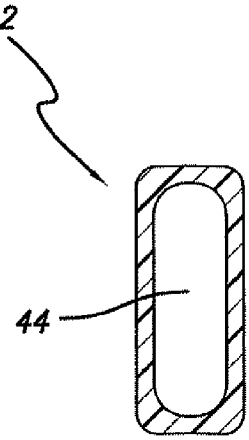
FIG. 3A is a cross-sectional view taken about the lines 3A-3A of FIG. 3.
Figure 3:
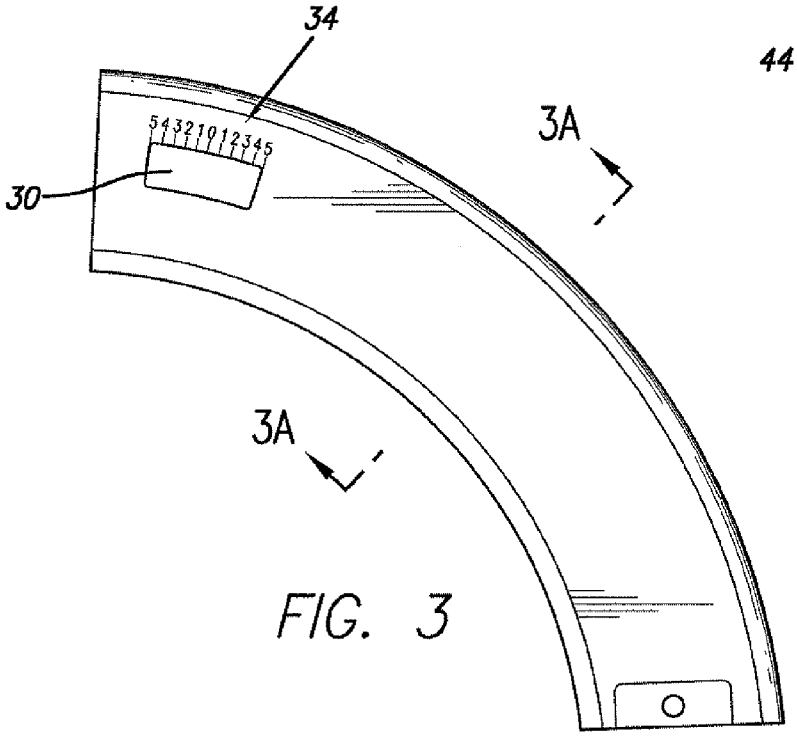
FIG. 3 is a front view of a first arcuate member of the golf swing instruction aide of the present invention.
Figure 4:
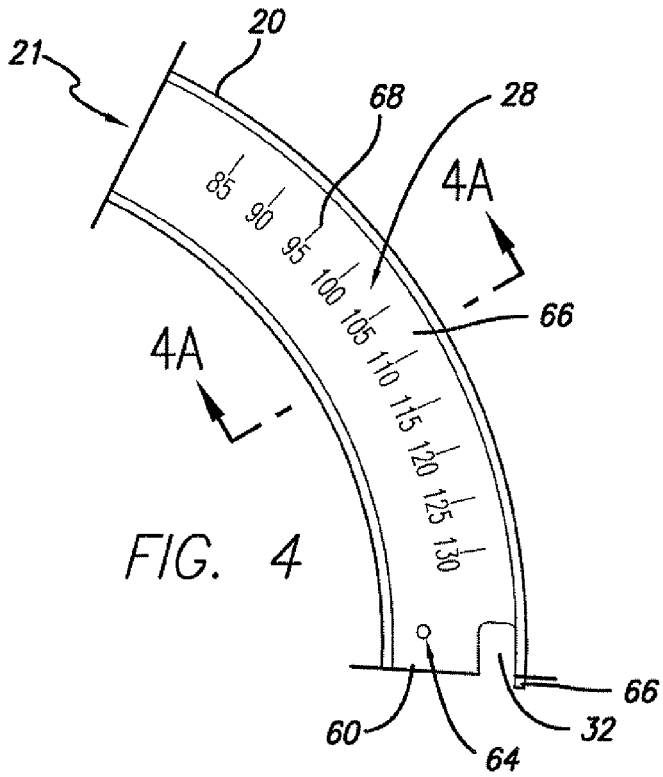
FIG. 4 is a front view of a second arcuate member of the golf swing instruction aide of the present invention.

Referring now more particularly to FIGS. 2 through 4, there is illustrated the first and second arcuate members in a position illustrative of a 90 degree wrist cock (FIG. 2) which is desired by the golfer for maximum distance during a golf swing. As is indicated in FIG. 4, indicia 28 is placed on a surface of the arcuate member 20 and is visible through a window 30 formed in the arcuate member 18 (FIG. 3). There is an indicator 34 showing that the relatively movable member 20 is at a position of a 90 degree wrist cock, which is desired for the longer shots in golf. This is shown by the 90 degree indicia being aligned with the "0" on the indicator 34. On either side of the "0" there is provided a vernier scale from 1 to 5 which tells the golfer the number of degrees which the arcuate member is displaced from the "0" indicator appearing in the window 30 if it is not directly aligned with the "0".

Referring now more particularly to FIGS. 3 and 3A, the first arcuate member 18 is illustrated in greater detail apart from the combination of the first and second arcuate members. As shown in FIG. 3A, the arcuate member 18 is a curved or arcuate hollow sheath 42 defining an interior opening 44 sufficient to slidably receive the arcuate member 20. The sheath 42 is preferably constructed of injection molded plastic such as Acrylonitrile Batadiene Styene (ABS) or Polyvinylchloride (PVC) or the like. It will be understood by those skilled in the art that other plastic materials such as Polypropylene or the like may be used as desired. The arcuate member 42 may be formed of two or more sections which are individually molded and then secured together by application of appropriate heat and pressure or an adhesive as is well known in the art to the mating joints to cause them to form the hollow sheath as illustrated at 42.

Figure 4A:
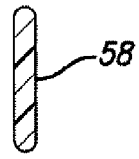
FIG. 4A is across-sectional view taken about the lines 4A-4A of FIG. 4.

Referring now more particularly to FIGS. 4 and 4A, the arcuate member 20 is shown in additional detail. As is therein illustrated, the arcuate member 20 is a solid molded arcuate member 58 as is shown in FIG. 4A and is preferably injection molded utilizing ABS, PVC, or Polypropylene or the like. At the end 60 of the arcuate member 20 there is provided a recess 62 the function of which will be described in greater detail below. There is also provided an aperture 64 and the function of the aperture will also be described in greater detail below in conjunction with FIG. 5. As is illustrated in FIG. 4, the indicia 28 is disposed along the surface 66 of the arcuate member 20. As above-indicated this indicia is visible through the opening 30 in the arcuate member 18. There is also provided at the end 60 of the arcuate member 18 a finger 66 which is dimensioned to provide frictional engagement with the hollow interior 44 of the arcuate member 18. This friction causes the member 20 to remain at the position to which it has been moved by the wrist cock of the golfer during the swing. As is also illustrated in FIG. 4, each of the numerals provided as part of the indicia 28 has a line 68 extending therefrom. The line 68 is used to determine the position of the member 20 internally of the member 18 by aligning with the indicator 34 (FIG. 3). The line 68 if aligned directly at the "0", for example, would indicate that the amount of wrist cock was 95 degrees. If it were either side of the "0" on the vernier numbers it would then indicate a greater or lesser number of degrees than 95. As illustrated in FIGS. 1 and 2, the opposite distal end 21 of the member 20 has the curved member or bow 23 affixed thereto.

Figure 5:
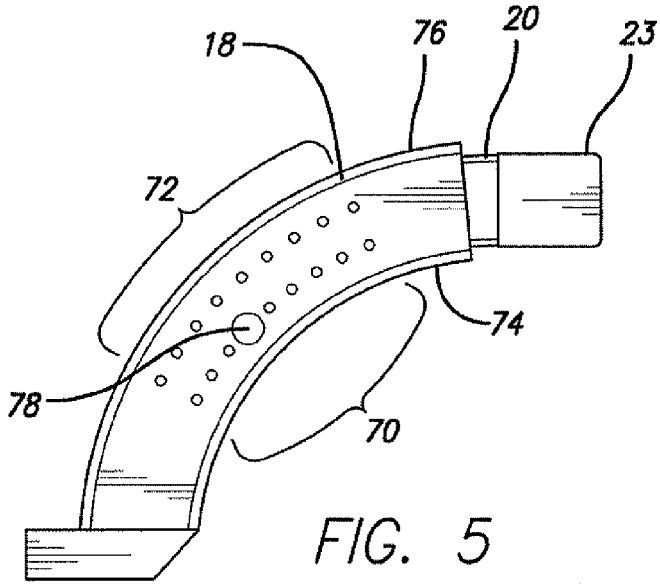
FIG. 5 is a rear elevational view of the golf swing instruction aide as shown in FIG. 2.

Referring now to FIG. 5, there is illustrated members 18 and 20 assembled but viewed from the rear thereof as opposed to FIG. 2, which illustrates a front view of the assembled arcuate members. As is illustrated in FIG. 5, the arcuate member 18 defines a plurality of apertures 70 and 72 disposed longitudinally there along but displaced inwardly from the edges 74 and 76 thereof respectively. When the user wishes to restrict the back swing or wrist cock that he/she wishes to practice, the arcuate member 20 is adjusted so that the line positioned at the desired degree for the swing or wrist cock is at the "0" indicator of the indicating apparatus 34. At that point a pin 78 is inserted through that one of the openings 70 which is aligned with the orifice 64 (FIG. 4) thus locking the bow 23 into a fixed position so that when the golfer exercises a particular swing the amount of wrist cock or back swing is controlled when the bow contacts the golfer's arm. In addition to the forgoing, if a golfer wishes to utilize the golf swing instruction aide so that the arcuate member 20 is allowed to slide internally of the opening 44 in the arcuate member 18 but wishes to restrict the movement to a certain degree of wrist cock at the end of the back swing then the pin 78 can be inserted into one of the openings 72 which will coincide with the amount of wrist cock that is desired to practice this particular aspect of the golf swing with the pin in place the arcuate member 20 is then extended outwardly from the arcuate member 18 so that the bow contacts the golfer's arm at the beginning of the wrist cock. As the arcuate member 20 then slides internally within the hollow portion 44 of the arcuate member 18 the recess 32 will engage the pin that has been placed within the selected opening 72 thus stopping movement of the arcuate member 20. In this manner, the golfer will know the exact amount of the wrist cock or back swing that has been taken during that stroke.

Figure 6:
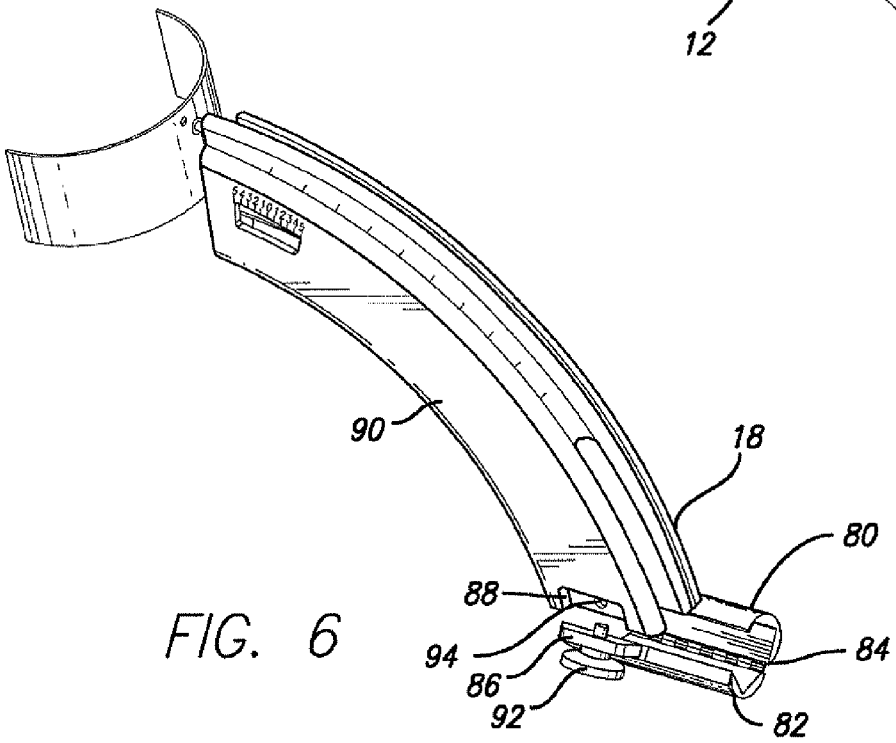
FIG. 6 is a partial exploded view of the golf swing instruction aide which illustrates the attaching means.

Referring now more particularly to FIG. 6, the clamping apparatus 22 is illustrated in greater detail. As is shown in FIG. 6, the various elements of the golf swing instruction aide of the present invention are shown in a somewhat exploded view. As is illustrated in FIG. 6, one half the clamping apparatus 22 as shown at 80 is molded as an integral part of one end of the arcuate member 18. The other half of the clamp 82 is formed as a separate member. The two halves 80 and 82 are formed to define a hinge 84 that rotateably couples the two halves 80 and 82 of the clamp together. The portion 82 of the clamp includes an extension 86 which fits within a recess 88 formed on the front portion 90 of the member 18. A threaded fastener 92 extends through an opening in the extension 86 and engages threads within an opening 94 provided in the recess 80. Thus, when the clamp 22 is fitted on the shaft 14 of the club 12 as shown in FIG. 1 the apparatus can be positioned so that the bow 23 properly aligns with the golfer's arm after which the fastener 92 is securely locked into the threaded opening 94 to maintain the swing aide instruction in the proper position on the golf club throughout the practice session irrespective of the type of golf swings which are taken.

There will now be described the manner in which the golf swing instruction aide of the present invention is utilized by the golfer either during instruction by a golf professional or during a practice session on the practice tee. The apparatus will be attached to the shaft 14 of the golf club 12 as is illustrated in FIG. 1 but the screw 24 will be left loose so that the apparatus may move rotationally about the axis of the club shaft 14. The arcuate member 20 is inserted into the arcuate member 18 until the line 68 on the 90 degree indicia is aligned with the "0" on the indicator 34 at which time the pin 78 will be inserted into the aligned orifices 64 to lock the members 18 and 20 into position to prevent relative movement therebetween. The golfer now grips the grip 16 on the shaft 14 in the normal manner to accomplish a golf swing For purposes of this description, it will be assumed that the golfer is right handed. Thus, the golfer's left hand will be at the terminus of the shaft 14 on the grip 16 with the right hand closer to the attaching mechanism 22. The golfer then executes the back swing to the degree such that the bow 23 seats against the left arm adjacent the wrist of the golfer. At this point the golfer knows that he has executed the desired wrist cock. While maintaining this wrist cock position with the left hand the golfer then tightens the fastener 92 to rigidly secure the golf instruction aide 10 to the golf club shaft 14. In this manner the aide is properly aligned on the golf club shaft. Alternatively of course the instructor, if the instructor is working with the golfer at this time, may place the golfer in the position such that the desired 90 degree wrist cock has been achieved and the instructor could then secure the instruction aide 10 to the golf club shaft 14 by tightening the fastener 92 to properly align the aide on the golf club shaft.

After the swing instruction aide 10 has thus been adjusted to fit the golfer utilizing the instruction aide, the pin 78 is removed from the aligned orifices 78 and 64 and the arcuate member 20 is retracted from the interior of the arcuate member 18 so that the member 64 is adjacent the golfer's left arm. The golfer then executes the normal golf swing taking his wrist cock throughout the swing as is normally done by the golfer.

As the golfer accomplishes this wrist cock, the wrist applies a force to the interior surface of the bow 23, thus urging the arcuate member 20 internally of the arcuate member 18 through the hollow opening 44 until the golfer has completed his or her desired amount of wrist cock during the execution of the golf swing. It is desired that the golfer execute his or her normal golf swing throughout without consciously trying to over extend the wrist cock. When the golf swing has been completed, the golfer may view the indicia 28 through the window 30 and determine the amount of wrist cock obtained between the golf club shaft 14 and the arm of the golfer. As is indicated by the indicia, if the golfer does not accomplish the 90 degree position of the golf shaft relative to the golfer's lower arm, then the indicia appearing at the indicator 34 may for example be 110 degrees, 100 degrees or some other intermediate position indicating that the golfer has not accomplished the desired 90 degree wrist cock for the maximum amount of distance. Of course as above indicated, if the golfer is practicing a shot such as a bunker shot, pitch shot, chip shot, or a partial swing for an approach to the green which requires an angular position of the golf club shaft to the golfer's arm which is greater than 90 degrees then the golfer can be practicing that particular wrist cock for the shot desired. There has thus been disclosed a golf swing instruction aide which is specifically adapted to assist and teach the golfer to accomplish the desired wrist cock for a particular golf shot during its execution and to provide an immediate feedback to the golfer as to the amount of wrist cock actually taken by the golfer during the execution of the shot. Although a specific embodiment of the golf swing instruction aide has been illustrated and described herein, it is to be understood that the scope of the invention is to be determined by the claims which are appended hereto.

What is claimed is:

1. A golf swing instruction aide comprising:

a. First and second arcuate members;

b. Means for attaching one of said first and second arcuate members to a golf club shaft adjacent the grip;

c. The other of said first and second arcuate members being movable relative to said one of said first and second arcuate members; and d. Means for measuring the amount of relative movement between said first and second arcuate members resulting from the wrist cock taken during the back swing portion of the golf swing.

2. The golf swing instruction aide as defined in claim 1 wherein said first arcuate member is adapted for attachment to the golf club shaft and is hollow.

3. The golf swing instruction aide as defined in claim 2 wherein said second arcuate member is received within said hollow first arcuate member.

4. The golf swing instruction aide as defined in claim 3 wherein one of said first and second arcuate members carries indicia indicating the wrist cock obtained during execution of the golf swing.

5. The golf swing instruction aide as defined in claim 4 wherein one of said first and second arcuate members includes means for detecting the position of said indicia on the other of said first and said second arcuate members.

6. The golf swing instruction aide as defined in claim 5 which further includes means for establishing and maintaining said first and second arcuate members in a fixed position representative of the desired wrist cock for a particular golf shot.

7. The golf swing instruction aide as defined in claim 6 wherein said means for establishing and maintaining includes apertures formed within said first and second arcuate members and a pin to be received within said apertures to prevent relative movement between said first and second arcuate members.

8. The golf swing instruction aide as defined in claim 3 wherein the distal end of said second arcuate member includes a curved seat adapted to engage the forearm of a golfer during execution of a swing.

9. The golf swing instruction aide as defined in claim 8 wherein said curved seat includes first and second arms.

10. The golf swing instruction aide as defined in claim 6 wherein said first arcuate member defines a plurality of openings spaced apart along its longitudinal axis and said second arcuate member defines an orifice therein and arranged sot that when a predetermined indicia is aligned with said means for detecting, a pin can be inserted into one of said opening and said orifice to prevent relative movement between said first and second arcuate members.

11. The golf swing instruction aide as defined in claim 1 wherein said means for attaching includes a clamp having first and second halves and a hinge interconnecting said first and second halves.

12. The golf swing instruction aide as defined in claim 11 wherein one of said first and second halves of said clamp is formed integrally with one of said first and second arcuate members.

13. The golf swing instruction aide as defined in claim 12 wherein the other half of said clamp includes an extension seated within a depression formed in said first arcuate member and a fastener seated within said extension and said first arcuate member to secure said clamp to said golf shaft.

* * * * *